US011096434B1

(12) United States Patent
Altshuler

(10) Patent No.: US 11,096,434 B1
(45) Date of Patent: Aug. 24, 2021

(54) FAST DEPLOYMENT FOGLESS FACE MASK

(71) Applicant: Alexander Altshuler, Cambridge, MA (US)

(72) Inventor: Alexander Altshuler, Cambridge, MA (US)

( * ) Notice: Subject to any disclaimer, the term of this patent is extended or adjusted under 35 U.S.C. 154(b) by 0 days.

(21) Appl. No.: 17/247,260

(22) Filed: Dec. 5, 2020

(51) Int. Cl.
*A41D 13/11* (2006.01)

(52) U.S. Cl.
CPC ..... *A41D 13/1161* (2013.01); *A41D 13/1138* (2013.01); *A41D 2300/32* (2013.01)

(58) Field of Classification Search
CPC ..... A41D 13/11; A41D 13/1161; A41D 13/1107; A41D 13/1146; A62B 18/025; A62B 18/084; A62B 18/086; A62B 23/025; A62B 18/006; A62B 18/08; A62B 18/10; A62B 23/02; A62B 23/06; A62B 7/10; A01K 13/006; A45D 44/12; A61D 7/04; A61F 5/08; A61M 16/06; A61M 16/0672; A61M 16/0683; A61M 16/0833; A61M 16/20; A61M 16/208; B63C 11/12; B63C 2011/128; G02C 11/00; G02C 3/003; Y10S 55/13; Y10S 55/35; Y10T 24/1371; Y10T 24/3413
See application file for complete search history.

(56) References Cited

U.S. PATENT DOCUMENTS

| | | | | | |
|---|---|---|---|---|---|
| 2,296,775 | A * | 9/1942 | Dockson | A41D 13/11 | 128/206.12 |
| 2,447,450 | A * | 8/1948 | Williams | A41D 13/1161 | 128/206.13 |
| 3,521,630 | A * | 7/1970 | Westberg | A62B 23/025 | 128/206.15 |
| 6,338,342 | B1 * | 1/2002 | Fecteau | A62B 18/084 | 128/207.11 |
| 7,836,887 | B1 * | 11/2010 | Kling | A41D 13/1161 | 128/206.16 |
| 2003/0029454 | A1 * | 2/2003 | Gelinas | A62B 23/025 | 128/205.27 |
| 2007/0044802 | A1 * | 3/2007 | Horne | A62B 18/084 | 128/206.19 |
| 2016/0332008 | A1 * | 11/2016 | McAndrews | A62B 18/084 | |
| 2017/0065838 | A1 * | 3/2017 | Bunge | A41D 13/1146 | |

* cited by examiner

*Primary Examiner* — Annette Dixon

(57) ABSTRACT

Disclosed is a face mask for filtering inhaled and exhaled air without fogging glasses of the mask wearer by providing superior seal along its upper edge. The mask of the invention also features quick switching between two stable positions on the wearer's face, deployed and stand-by and may be manipulated without touching the filter media. A large breathing chamber of the disclosed mask provides for comfortable wearing without undue touching of the wearer's facial features and for easy breathing by maximizing active filtering area of the filter media. In one preferred embodiment the mask may be constructed as a disposable filter media removably attached to the external frame. In another preferred embodiment a single use disposable mask with a built in wireframe is disclosed.

12 Claims, 6 Drawing Sheets

FAST DEPLOYMENT FOGLESS FACE MASK

BACKGROUND INFORMATION

Field of the Disclosure

The present disclosure relates to a protective mask useful in preventing inhalation of airborne materials by the wearer from the environment as well as in preventing exhalation of infectious particles by the wearer to the environment. More particularly, the disclosure exemplifies a personalized protective mask which allows the user to conveniently wear it in a stand-by position, yet keeping it ready for immediate deployment on the face whereby it conforms to the contour of the particular wearer's face thereby preventing glasses fogging.

Description of the Related Art

Even though face masks had been used very widely in the medical field and by general public for filtering air pollutants in the past, COVID-19 pandemic led to increase manifold in mask usage. And it is not just the number of face masks being used that has significantly changed, but the entire purpose for wearing face masks has changed completely. During the pandemic, the masks are not just used to protect the mask wearers, but also to a large degree to protect other people from the mask wearers themselves in case they happen to be actually contagious. While for the sake of personal protection most individuals will readily sacrifice convenience and endure some discomfort, going through troubles of wearing currently available face masks for protecting others may not be that appealing to a large number of self centered individuals. Yet, it is paramountly consequential for the containment of the pandemic to maximize number of mask wearers in public to reduce contagion transmission. In such a context, convenience and comfort of mask wearing is raised to the utmost importance.

Despite such a strong need for user convenience, current face masks are quite far from ideal. The most prevailing type of a single use surgical mask is generally a pleated rectangle of filter media held on the wearer face by two elastic ties going either over the user's ears or over the user's head. A short length of a bendable wire inserted into the central section of upper seem of the rectangle helps somewhat to reduce the gaps around the wearer's nose. However, a number of problems associated with wearing this type of masks still exist. a) Even the most malleable material of the bendable nose wire exhibits some spring back effect creating a gap around the wearer's nose. In addition, elastic ties holding the upper section of the mask also pull on that bent wire increasing the gap even more. This particular leak of exhaled air from the top of the mask often leads to fogging mask wearer's glasses, one of the biggest complaints of mask wearers. b) Even a very gentle press on the tip of the nose by the mask over a long period of time of mask wearing may create an uncomfortable feeling and even pain. c) With various face movements, mask may gradually shift its position on the wearer's face. To reposition the mask, short of completely removing and putting it back on, the user has to touch and get hold of the mask outside surface thus risking finger contamination. d) The same problem of finger contamination arises when user needs to temporary remove the mask from the face to a stand-by position on or under the chin and then put it back. e) As most of the mask area is pressed against the wearer's face, a relatively small portion of the available filter material participate in air filtering during the inhalation phase of breathing, leading to increased air resistance and breathing difficulty.

SUMMARY OF EXEMPLARY EMBODIMENTS

Accordingly, it is the object of the present invention to provide a face mask that will not fog wearer's glasses, is simple and fast to deploy and to switch to stand-by, feels comfortable to wear on a face, is easy to bread through, and may be manipulated without touching the filter material.

Instead of relying on adjustment of a stretch of malleable wire to conform exactly to the shape of the wearer's nose and sealing filter media top edge to prevent air leaks in the nose area, which proved to be extremely difficult to achieve, the mask of the present invention uses natural flexibility of the filter media material to closely wrap itself over the nasal dorsum when tightly pressed to the cheeks on either side of the nose. This results in consistent tight air seal around the nose that does not depend on the malleable wire properties and wire bending skills of the user.

According to at least one embodiment of the invention, there is provided a face mask comprising a patch of air filter media removably affixed to a substantially rigid frame held against a wearer's face with an elastic tie. The frame rests on the wearer's chin below the bottom lip and on both wearer's cheeks on both sides of and in close proximity to the nose. An unsupported section of the filter media straddles between the two cheek attachment pads closely conforming to the shape of the wearer's nasal dorsum and thus preventing exhaled moist air from leaking up along the nose and cheeks area of the filter patch and reducing or eliminating glasses fogging problem. An additional chin strap supports the chin pad(s) allowing for quick switching the mask between a deployed and a stand-by positions. A section of the frame is adapted for the wearer's manipulation of the mask without the need to touch the possibly contaminated filter media. A large inner portion of the filter media patch is supported by the frame away from the wearer's face providing for more comfortable mask wearing and more efficient usage of the filter media area for easier breathing.

Other embodiments of the present invention further comprise a central stop feature for more secure stand-by position and/or side arms with side pads to press side edges of the filter media patch against wearer's cheeks.

Yet another embodiment of the present invention provides a disposable mask with an integral adjustable malleable wireframe resting on the wearer's chin and on both cheeks in close proximity to and on both sides of the nose. The frame may be placed and partially secured between layers of filter media. In yet another embodiment the frame may be placed in a special pocket in the filter media patch. Both of the above described embodiments take advantage of the flexible unsupported portion of filter media pushed against the wearer's cheeks on its either end to conform to the exact shape of wearer's nose and create an air seal.

These and other objects, features, and advantages of the present disclosure will become apparent upon reading the following detailed description of exemplary embodiments of the present disclosure, when taken in conjunction with the appended drawings, and provided claims.

BRIEF DESCRIPTION OF DRAWINGS

Further objects, features and advantages of the present disclosure will become apparent from the following detailed description when taken in conjunction with the accompanying figures showing illustrative embodiments of the present disclosure.

FIG. 3 shows the mask supported by an elastic tie over the back of the head and a chin strap.

FIG. 4 shows the mask supported by an elastic tie over the top of the head and a chin strap.

FIG. 5 shows the mask supported by an elastic tie over the top of the head without a chin strap.

FIG. 6 shows the mask supported by two over ear elastic ties.

Figure 1A:
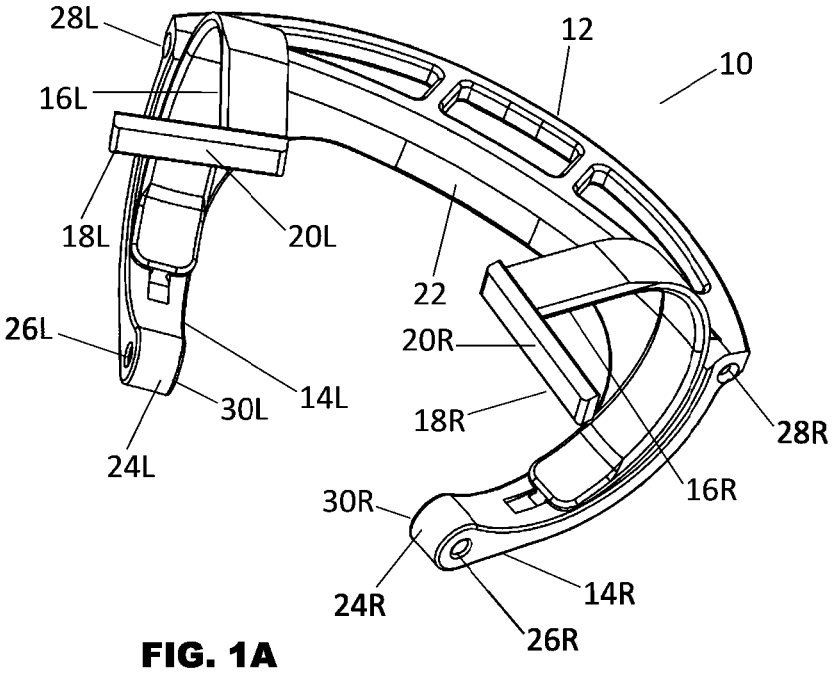
FIG. 1A is a perspective view of a rigid frame of a face mask of the present invention.

Throughout the figures, the same reference numerals and characters, unless otherwise stated, are used to denote like features, elements, components or sections of the illustrated embodiments. Substantially symmetric features, elements, and components belonging to the left and the right portions of the mask are denoted in the figures by the same numerals appended with suffixes L and R correspondingly. Wherever a wearer's head shall be shown in the figure to illustrate mask usage and functioning, it is shown in those figures with dotted lines to clearly distinguish it from features and elements of the mask of the present invention. Where in some side views of the illustrated embodiments two components, features, or vectors are superimposed due to the symmetry and therefore cannot be seen both in the same view, the number corresponding to that not visible component, feature, or vector would be shown in parentheses in that view.

Moreover, while the subject disclosure will now be described in detail with reference to the figures, it is done so in connection with the illustrative exemplary embodiments. It is intended that changes and modifications can be made to the described exemplary embodiments without departing from the true scope and spirit of the subject disclosure as defined by the appended claims.

DETAILED DESCRIPTION OF EXEMPLARY EMBODIMENTS

In referring to the description, specific details are set forth in order to provide a thorough understanding of the examples disclosed. In other instances, well-known methods, procedures, and components have not been described in detail as not to unnecessarily lengthen the present disclosure.

It should be understood that if an element or part is referred herein as being "on", "against", "affixed to", or "attached to" another element or part, then it can be directly on, against, connected or coupled to the other element or part, or intervening elements or parts may be present. In contrast, if an element is referred to as being "directly on", "directly affixed to", or "directly attached to" another element or part, then there are no intervening elements or parts present. When used, term "and/or", includes any and all combinations of one or more of the associated listed items, if so provided.

Spatially relative terms, such as "under" "beneath", "below", "lower", "above", "upper", "proximal", "distal", and the like, may be used herein for ease of description to describe one element or feature's relationship to another element(s) or feature(s) as illustrated in the various figures. It should be understood, however, that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a relative spatial term such as "below" can encompass both an orientation of above and below. The device may be otherwise oriented (rotated 90 degrees or at other orientations) and the spatially relative descriptors used herein are to be interpreted accordingly. Similarly, the relative spatial terms "proximal" and "distal" may also be interchangeable, where applicable.

The terms describing elements, components, regions, parts and/or sections properties, such as "rigid", "flexible", "stretchable", "elastic", and the like shall only be understood as relative in comparison to properties of other element, components, regions, parts and/or sections rather than absolute. It should be understood that these elements, components, regions, parts and/or sections should not be limited by these terms. These terms have been used only to emphasize prevalent properties of one element, component, region, part, or section as compared to the properties of another element, component, region, part, or section.

The terminology used herein is for the purpose of describing particular embodiments only and is not intended to be limiting. As used herein, the singular forms "a", "an", and "the", are intended to include the plural forms as well, unless the context clearly indicates otherwise. It should be further understood that the terms "includes" and/or "including", when used in the present specification, specify the presence of stated features, integers, steps, operations, elements, and/or components, but do not preclude the presence or addition of one or more other features, integers, steps, operations, elements, components, and/or groups thereof not explicitly stated.

Figure 1B:
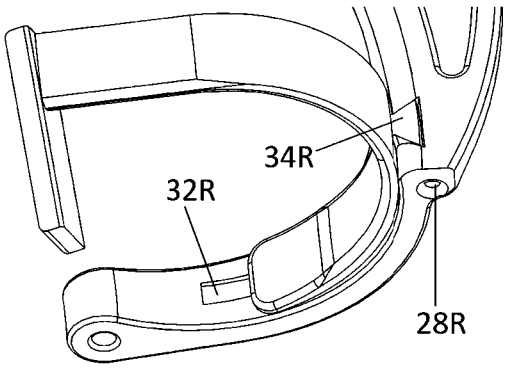
FIG. 1B is a partial perspective view of the rigid frame of a face mask of the present invention of FIG. 1A showing details of an adjustable cheek arm.

One of the preferred embodiments of the present invention comprises a disposable patch of flexible filter media removably affixed to a rigid non-disposable frame held to the wearer's face with a highly stretchable tie. The frame is preferably made of a light, rigid material like plastic, but any suitable material may be used without deviating from the scope of the present invention. Using a thermoplastic material for the frame will allow for mass-producing the frame through injection molding. Alternatively, such frame may be custom manufactured by a commercial 3D printing technique from measurement data for each particular user without a need for any later adjustments. A perspective view of a frame 10 of the face mask of the present invention is shown in FIG. 1A and FIG. 1B in details. A central arch 12 serves as a backbone for combining other functional frame components together. It also functions itself as a handle for user manipulation of the mask. The central arch 12 has two chin arms, left 14L and right 14R, protruding downwards from its both left and right sides correspondingly. Each chin arm 14L and 14R ends with a pivot pad 30L and 30R having partially cylindrical surfaces to facilitate easy rolling over the wearer's chin. Each of the two chin arms 14L and 14R has a corresponding cheek arm 16L and 16R adjustably attached to it. Each of the cheek arms 16L and 16R terminates at the upper end with a cheek pad 18L and 18R correspondingly. These frame components positioned above the central arch 12 in the deployed position of the mask, cheek arms 16L and 16R and cheek pads 18L and 18R, collectively form upper support section of the frame. The cheek pads 18L and 18R are adapted to rest on the wearer's cheeks below eyes on either side of the nose. A V-groove, like 32R, incorporated into each chin arm and a mating V shaped protrusion on each cheek arm, such as 34R, allow for adjustment of relative positions of cheek pads 18L and 18R on the wearer's face.

Figure 2A:
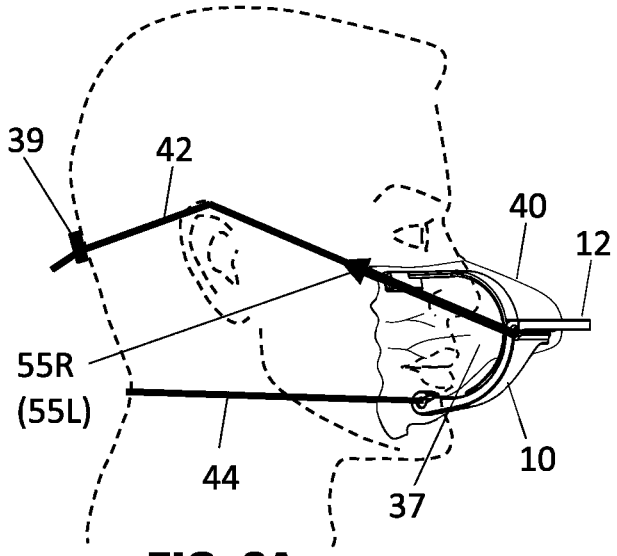
FIG. 2A is a side view of the face mask of the present invention being worn by a user in the mask deployed position.
Figure 2B:
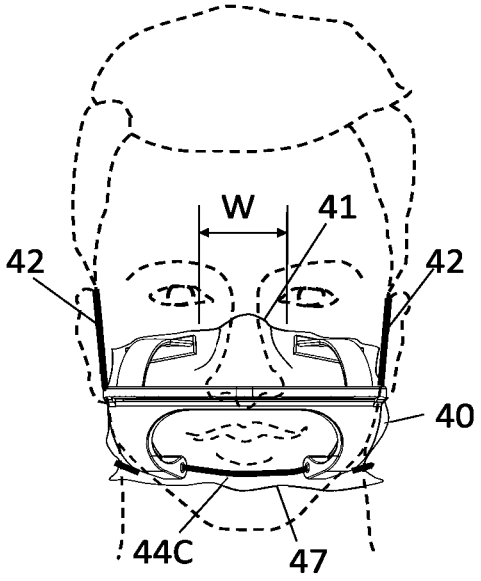
FIG. 2B is a front view of the face mask of the present invention being worn by a user in the mask deployed position.

Referring now also to FIG. 2A and FIG. 2B showing the mask of the present invention in use as deployed on a wearer's face. Holes 28L and 28R in either end of the central arch 12 serve as anchor points for attachment of an elastic tie 42. The preferred material for the tie 42 is a readily available highly stretchable synthetic cord made of combination of polyester and spandex materials widely used for ear loops of surgical masks. However, any suitable stretchable material may be used without deviating from the scope of the present invention. The tie 42 may also be made adjustable in length by incorporating an additional suitable cord lock 39, well known in the art, to accommodate different head sizes and mask fitting preferences. As the tie 42 stretches around the wearer's head, it develops elastic forces applied to the frame's 10 anchor points 28L and 28R. These forces are represented by vectors 55R and 55L. The elastic forces are then distributed through the rigid frame 10 to apply pressure to the wearer's face in 4 regions corresponding to the frame pivot pads 30L and 30R and cheek pads 18L and 18R. A chin strap 44 is threaded through the frame holes 26L and 26R to additionally secure the pivot pads 30L and 30R in place against the wearer's chin at all times. The chin strap 44 is made of a flexible material to be routed over the wearer's neck, and is preferably, but not necessarily, should also be made of elastic and somewhat stretchable material. It may even be made of the same material as the elastic tie 42. Furthermore, central section 44C of the chin strap 44 may also function as an additional pivot for mask opening operation and to form a pivot section of the mask combined with pivot pads 30L and 30R. Surfaces 24L, 24R, 20L, 20R, and 22 of the frame 10 are adapted for removable attachment of a patch of filter media 40. In some embodiments these surfaces may have a "hook-and-loop" type fastener pads affixed to them. In other embodiments these surfaces may incorporate temporary glue for that purpose. In some further embodiments a wearer may just rely on friction to hold the filter media in position against the wearer's face. And yet in other embodiments there may be mechanical retention means adapted to hold the filter media. Attached to the surfaces as described, the filter patch will assume a "duck bill" shape similar to one shown in FIG. 2A and FIG. 2B, providing larger enclosed air volume in front of the nose and the mouth, a so called breathing chamber 37, and maximizing use of filter media surface area to lower air flow resistance for easier breathing. The filter media is preferably a multilayer non-woven fabric specifically developed for efficient filtering of air contaminants and ease of breathing and readily available from a number of manufacturers. For even more choices, almost any commercial pleated surgical mask, with minimal alternations, can be used as a filter media for the mask of the present invention. While the described embodiment of the present invention is employing a disposable patch of filter media, another embodiment of similar configuration may be provided with reusable patch of filter media without deviation of the present invention.

Figure 2C:
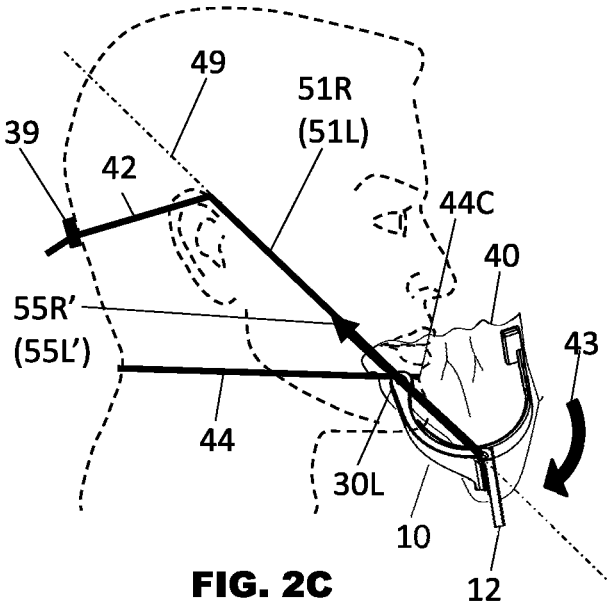
FIG. 2C is a side view of the face mask of the present invention being worn by a user when the mask is at a point of unstable equilibrium while being switched between the mask deployed and the mask stand-by positions.
Figure 2D:
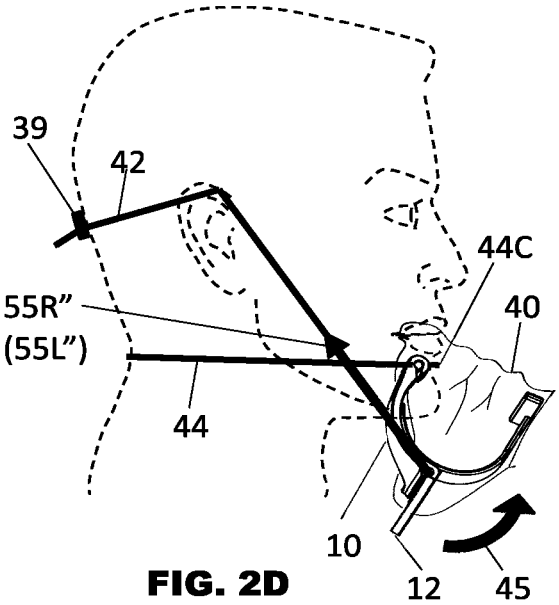
FIG. 2D is a side view of the face mask of the present invention being worn by a user in the mask stand-by position.
Figure 3:
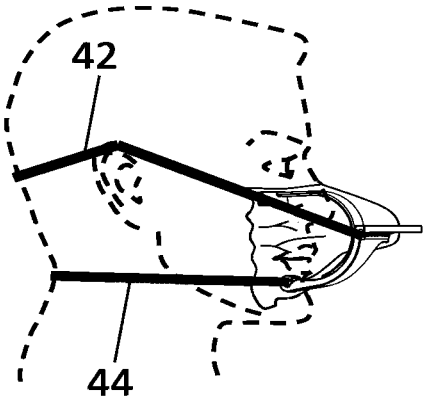
FIGS. 3 through 6 are side views of different embodiments of the face mask of the present invention being worn by a user in the mask deployed position having different mask support options.
Figure 4:
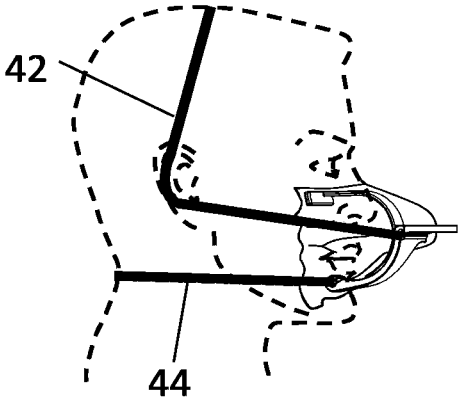

It should be appreciated that, when the mask of the illustrated embodiment of the present invention assembled as described above, the frame 10 acts as an exoskeleton for the filter media 40, and they both form a single body after attachment. Referring now to FIG. 2C and FIG. 2D, the action of switching the mask from the deployed position of FIG. 2A and FIG. 2B to a stand-by position of FIG. 2D starts with the user applying downwards force to the central frame arch 12, which also serves as a handle for the mask manipulations, in a general direction represented by an arrow 43. As soon as force applied by the user overcomes the elastic forces of the tie 42 holding the frame against the user's face, the frame with the attached filter patch will start turning about the pivot section of the mask formed by the pivot pads 30L and 30R of the frame 10 and the central section 44C of the chin strap 44. As the elastic tie stretches while the mask is pivoting, the direction of the vectors of elastic forces applied by it to the anchor points of the frame 10 changes to coincide with the two straight taut sections 51R and 51L of the elastic tie 42. As the mask is pivoting downwards it will reach an unstable equilibrium position, as illustrated in FIG. 2C, characterized by a plane 49 defined by changed vectors of elastic force 55R' and 55L', crossing the pivot section of the mask. After passing this position the mask may continue pivoting driven by the elastic forces of the tie 42 without user's help until it reaches and stops in the stand-by position of FIG. 2D. The mask is held in the stand-by position by the elastic forces represented by now new vectors 55R" and 55L" developed by the elastic tie 42. The exact stand-by position will be defined by interference of the two chin arms 14L and 14R, filter media, and the wearer's chin shape. Having the mask in its stand-by position will allow for easy breathing, talking, drinking, eating, and other user activities when surrounding air contamination risk is low. Switching the mask back to deployed position is as simple as opening it up to the stand-by. The user should just apply force to the central frame arch 12 in somewhat forward-upwards direction represented by an arrow 45 to get it to pivot over the equilibrium position, then the mask will seat itself back on the user's face by the elastic force of the tie 42. It should be clear from the above description that the entire action of switching the mask position between the deployed and the stand-by is carried on without a need for the wearer to touch possibly contaminated outside surface if the filter, which is yet another benefit of the present invention.

Another advantage of the present invention may be easily described by referring again to FIG. 1A through FIG. 2B. As was previously noted, the frame of the present invention is pressing the filter media against the wearer's face in 3 distinct regions, a pivot region in the front portion of the wearer's chin by the surfaces 24L and 24R and two substantially symmetric regions on the wearer's cheeks at either side of the nose by the surfaces 20L and 20R. It was also noted that the relative position of the cheek pads 18L and 18R on the wearer's face is user adjustable. This adjustment will allow to fine-tune the distance "W", as shown in FIG. 2B, so that the surfaces 20L and 20R are resting on the cheeks as close to the nose as possible, but without touching the nose itself. After the frame of the mask of the present invention is preadjusted as such for a particular wearer and the top edge of the filter media patch is affixed to the frame surfaces 20L and 20R with just enough slack, and no more edge length of an unsupported portion 41 of the filter media than needed to closely follow the surface if the wearer's nose, the entire top edge of the filter media patch will be sealed sufficiently to prevent hot moist air from escaping upwards and from fogging wearer's glasses (not shown). The surface of the nasal dorsum of the wearer will be tightly wrapped by the edge 41 of the filter media from the left cheek to the right cheek.

The process of installation of a new disposable filter on the preadjusted frame of the present invention will now be described. The correct length 41 of the filter media patch edge between surfaces 20L and 20R may be easily determined by applying the filter patch's top edge directly over the wearer's nasal dorsum from cheek to cheek immediately prior to the filter installation. After the filter top edge anchor points are established this way, the filter may be readily attached to the frame surfaces 20L and 20R at these exact points. Next, the central portion of the filter patch is to be affixed to the surface 22 of the mask frame creating sufficient volume inside the mask for the filter material not to touch the tip of the wearer's nose. Finally, the lower edge of the filter patch needs to be affixed to the surfaces 24L and 24R in a way to allow some portion 47 of the filter media to stay under the central portion 44C of the chin strap 44 to maintain air seal along the lower edge of the filter.

Figure 5:
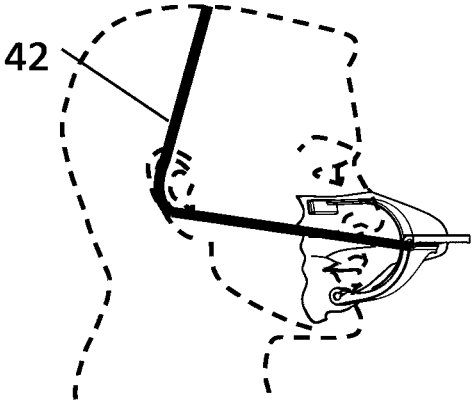
Figure 6:
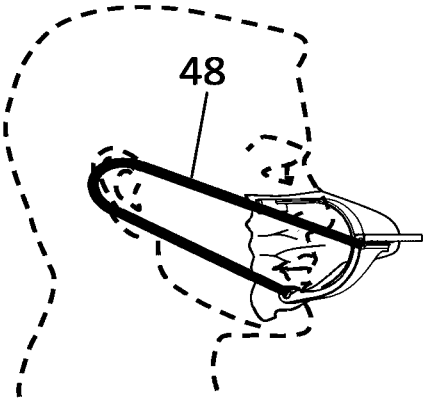

Several more embodiments of the present invention differing in the mask attachment methods are shown in FIG. 3 through FIG. 6. Compared to the embodiment of FIG. 3 already described above, where elastic tie 42 is placed over the wearer's ear and over the back of the head, the embodiment of FIG. 4 features an alternative routing of the elastic tie 42 under the wearer's ears and over the top of the head. These two embodiments are materially identical in a sense that they do not require any mask changes, but they are giving the wearer a choice to select from for personal preference and convenience. Yet another embodiment is shown in FIG. 5. In this embodiment the chin strap is entirely omitted. This design will be beneficial due to its simplicity for applications primarily centered on the goal of reducing fogging of glasses, rather than on quick switching between deployed and stand-by positions. And still another embodiment, shown in FIG. 6 employs familiar from common surgical masks elastic ear loops 48 on either side of the head to replace and combine both the elastic tie 42 and the chin strap 44.

Figure 7:
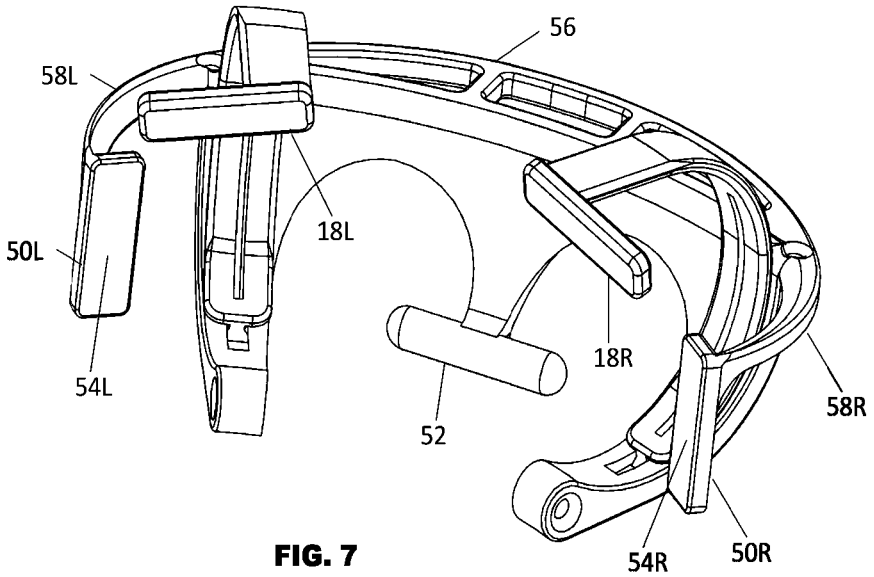
FIG. 7 is a perspective view of a rigid frame of yet another embodiment of the face mask of the present invention.

Still the mask frame of yet another embodiment of the present invention shown in FIG. 7 reveals several additional features as compared to the mask frame of FIG. 1A. Firstly, the central stop 52 protruding downwards from the central arch 56 is adapted to provide a positive stop for the mask frame in the stand-by position by resting on the chin underside. This may prevent some inconvenient stand-by position variability due to inconsistency in filter media attachment to the pivot portion of the frame by the user.

While proper sealing of the side edges of the filter material against the wearer's face may be achieved by appropriate designing a shape of the filter patch by not allowing extra slack on either side, it is still feasible to use the mask of the present invention employing a readily available surgical mask or other materials as a disposable filter media. To make sure the side edges of the filter are held securely against the wearer's face, two side arms 58L and 58R extend additionally from the central arch 56, each ending with a side pad, 50L and 50R correspondingly, adapted to slightly press on the side portions of the filter patch.

Figure 8:
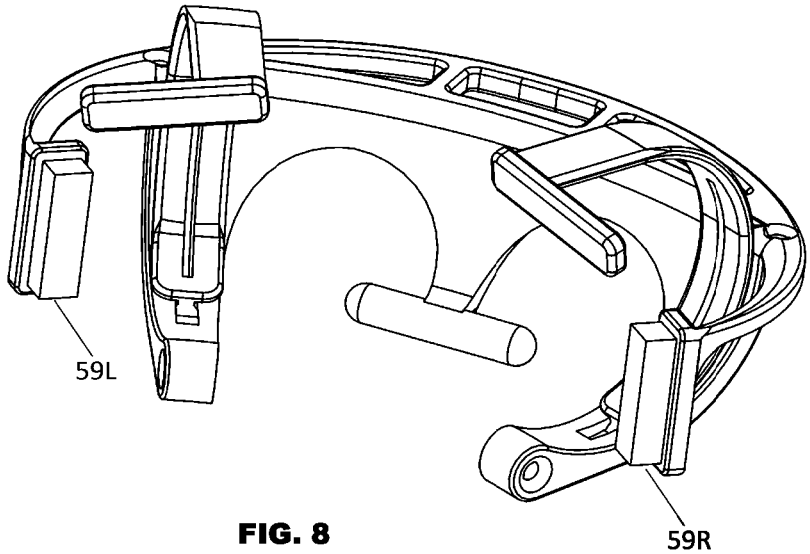
FIG. 8 is a perspective view of a rigid frame of yet another embodiment of the face mask of the present invention.

It is very important for maintaining glasses fogless using the mask of the present invention to apply sufficient pressure, developed by stretching of the elastic tie 42 or 48, to the cheek pads 18L and 18R to properly seal the filter media around the wearer's nose and on the cheeks. However, for some user faces, most of the elastic force may be applied to the side pads 50L and 50R rather than to the cheek pads 18L and 18R. To prevent that from happening, another embodiment may further incorporate adjustable side arms 58L and 58R, with a V-groove adjustment mechanism similar to the one of the cheek arms 16R and 16L. And yet another embodiment illustrated in FIG. 8 may have soft pads 59R and 59L affixed to the surfaces 54L and 54R to conform to a particular shape of the wearer's face without pushing the cheek pads 18L and 18R away from the wearer's face. The pads may be made of any suitable soft compressible material or constructed of mechanical flexures.

Figure 9:
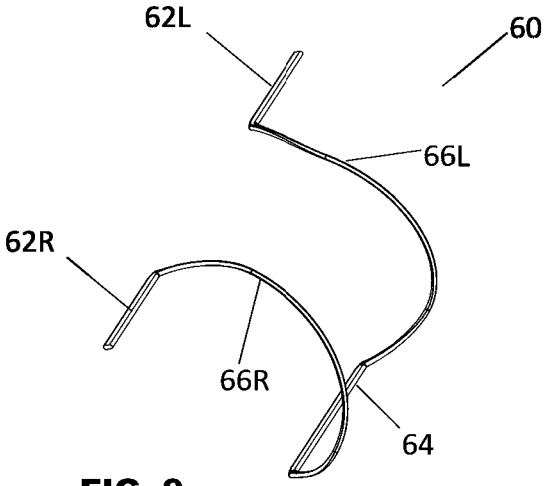
FIGS. 9 and 10 are perspective views of a frame and a complete mask employing this frame of still another embodiment of the face mask of the present invention.
Figure 10:
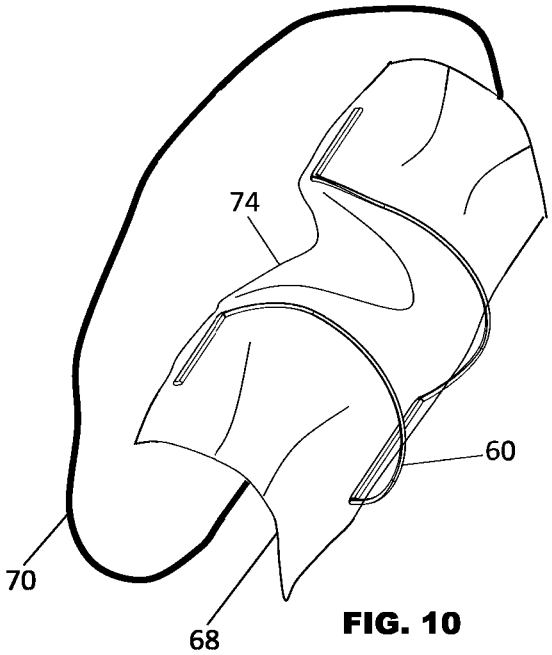

It should be understood, that many more embodiments may be suggested without departing from the scope of the present invention. For example, even though the above illustrated embodiments were described as having a disposable filter patch and a reusable frame, yet another embodiment, such as illustrated in FIGS. 9 and 10, may comprise a disposable filter media patch with a disposable malleable wire frame incorporated into the filter in accordance to the teaching of the present invention. The wire frame 60 is a single bent stretch of wire with preformed pivot segment 64 and cheek segments 62L and 62R. Two side arches 66L and 66R connecting pivot and cheek segments may be supplied prebent as shown in FIG. 9 or in flat form with anticipation that the wearer will form them to conform to the wearer's face.

The frame 6*o* then may be combined with a filter media patch 68, as shown in FIG. 10. It may be just positioned between two layers of a multilayer ofilter media and affixed to the filter patch by the pivot segment 64 or placed in a specially made pocket in the filter patch. Whatever the attachment method is selected, the two cheek segments 62L and 62R of the frame shall be free to be bent and to move relative to the filter media 68 so the wearer can adjust the size of an unsupported portion of the filter 74 to conform tightly to the surface of the wearer's nose without any gap created by extra filter media length in unsupported portion 74 while cheek segments 62L and 62R are pressing the upper edge of the filter material against the wearers cheeks by the elastic force of an elastic tie 70. It should be apparent from the above description that the mask of the FIGS. 9 and 10 provides superior seal along the upper edge of the filter, thus preventing fogging of the wearer's glasses.

In yet another embodiment the cheek segments 62L and 62R may be extended in length to be bent downwards, conforming to shape of the wearer's face, and additionally provide face seal on the side edges of the filter media if needed.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

While the present disclosure has been described with reference to exemplary embodiments, it is to be understood that the present disclosure is not limited to the disclosed exemplary embodiments. The scope of the following claims is to be accorded the broadest interpretation so as to encompass all such modifications and equivalent structures and functions.

What is claimed is:

1. A face mask switchable by a wearer between a stand-by and a deployed positions comprising:

a substantially rigid frame adapted to be positioned over the wearer's face in the deployed position, the frame comprising:

a pivot section adapted to pivotly rest on the wearer's face between the wearer's lower lip and the lowermost point of the wearer's chin in both the deployed and the stand-by positions of the mask;

an upper support section adapted to rest on the wearer's face above and apart from the pivot section in the deployed position of the mask; and an anchor section;

a patch of filter media affixed to the rigid frame and adapted to at least partially cover the wearer's face;

an elastic tie coupled to the frame at the anchor section on either side of the wearer's face and having a sufficient length and stretchability to support the rigid frame resting against the wearer face in both, the stand-by and the deployed positions, and any intermediate position in-between, by applying an elastic force to the frame in a direction along the elastic tie, wherein the deployed position of the mask is characterized by the pivot section resting between the wearer's lower lip and the lowermost point of the wearer's chin and the upper support section resting on the wearer's face above and apart from the pivot section with the anchor section positioned below the upper support section and above the pivot section, wherein the stand-by position of the mask is characterized by the pivot section resting between the wearer's lower lip and the lowermost point of the wearer's chin and the upper support section resting away from the wearer's face with the anchor section positioned below the pivot section, and wherein switching between the stand-by and the deployed positions entails pivoting the frame over the pivot section by sequentially partially stretching and then partially relaxing the elastic tie.

2. The face mask according to claim 1, further having a top edge and featuring reduced wearer's glasses fogging by providing air seal along the top edge, wherein the upper support section comprises two distinct cheek pads spaced along the top edge and adapted to rest on the wearer's cheeks one at each side of the wearer's nose and in close proximity thereof, wherein the patch of filter media is affixed to the rigid frame at each of the two distinct cheek pads with a portion of unsupported flexible filter media disposed between the two cheek pads along the top edge, and wherein the portion of unsupported flexible filter media disposed between the two cheek pads is sized to closely follow and tightly wrap around the surface of the wearer's nasal dorsum to form an air seal along a segment of the top edge adjacent to the nose, forced to assume nasal dorsum's shape by being taut between the two cheek pads.

3. The face mask according to claim 2, wherein one or more of the following:

(i) the frame further comprises a handle section adapted for the wearer to manipulate the mask with the wearer's hand;

(ii) the distance between the two distinct cheek pads is wearer adjustable;

(iii) the frame is adapted to keep filter media away from the wearer's tip of the nose and the mouth and to form a breathing chamber;

(iv) the pivot section further comprises at least two distinct pads;

(v) the face mask further comprises at least one filter media attachment surface at the pivot section of the rigid frame;

(vi) the face mask further comprises at least one filter media attachment surface between the pivot section and the upper support section of the frame;

(vii) the frame further comprises one or more hook-and-loop fasteners adapted to temporarily affix the patch of filter media to the frame;

(viii) the frame further comprises one or more temporary adhesive spots adapted to temporarily affix the patch of filter media to the frame;

(ix) the frame further comprises one or more mechanical clamping means adapted to temporarily affix the patch of filter media to the frame;

(x) the patch of filter media is adapted to be retained against the wearer's face in desired position by friction;

(xi) the frame further comprises a central stop adapted to provide a positive mask stand-by position by resting on the wearer's under-chin;

(xii) the patch of filter media is adapted to be a single use part;

(xiii) the patch of filter media is adapted to be a reusable part;

(xiv) the length of the elastic tie is wearer adjustable;

(xv) the frame and the filter media are permanently attached or fused together;

(xvi) the elastic tie is adapted to route over the top of the wearer's ears and around the back of the wearer's head;

(xvii) the elastic tie is adapted to route under the wearer's ears and around the top of the wearer's head.

4. The face mask according to claim 3, further comprising a chin strap adapted to support the pivot section of the frame against the wearer's chin.

5. The face mask according to claim 4, wherein the chin strap and the elastic tie are permanently attached or fused together to form ear loops.

6. The face mask according to claim 4, wherein the frame further comprises two side arms ending with two corresponding side pads adapted to hold filter media against the sides of the wearer's cheeks.

7. The face mask according to claim 6, wherein the two side pads are wearer adjustable.

8. The face mask according to claim 6, comprising at least two soft compliant pads affixed to each of the two side pads and adapted to hold filter media against the sides of the wearer's cheeks without breaking the seal between the wearer's face and the cheek pads of the upper support section.

9. A face mask having a top edge and featuring reduced wearer's glasses fogging by providing air seal along the top edge comprising:

a substantially rigid frame adapted to be positioned over a wearer's face comprising:

a pivot segment adapted to rest on the wearer's face below the wearer's lower lip and above the lowermost point of the chin; and two distinct cheek segments spaced along the top edge and adapted to rest on the wearer's cheeks one at each side of the wearer's nose and in close proximity thereof;

an elastic tie coupled to the mask and adapted to support the mask against the wearer's face; and a patch of filter media adapted to at least partially cover the wearer's face and held against the wearer's face by the each of the two cheek segments with a portion of unsupported flexible filter media disposed between the two cheek segments along the top edge, wherein the portion of unsupported flexible filter media disposed between the two cheek segments is sized to closely follow and wrap around the surface of the wearer's nasal dorsum to form an air seal along a segment of the top edge adjacent to the nose, forced to assume nasal dorsum's shape by being taut between the two cheek segments.

10. The face mask according to claim 9, wherein one or more of the following:

(i) the filter media is constructed of at least two distinct layers and the frame is contained between two of the at least two distinct layers;

(ii) the frame is made of a malleable wire-like material;

(iii) the frame is adapted for the distance between the two distinct cheek segments to be wearer adjustable;

(iv) the frame is adapted to keep filter media away from the wearer's tip of the nose and the mouth and to form a breathing chamber;

(v) the pivot segment of the frame is affixed to the patch of filter media;

(vi) the patch of filter media is adapted to be retained against the wearer's face in desired position by friction;

(vii) the frame is adapted to be intended as a disposable frame;

(viii) the frame is adapted to be intended as a reusable frame;

(ix) the length of the elastic tie is wearer adjustable;

(x) the elastic tie is adapted to route over the top of the wearer's ears and around the back of the wearer's head;

(xi) the elastic tie is adapted to route under the wearer's ears and around the top of the wearer's head.

11. The face mask according to claim 10, further comprising a chin strap adapted to support the pivot section of the frame against the wearer's chin.

12. The face mask according to claim 11, wherein the chin strap and the elastic tie are permanently attached or fused together to form ear loops.

* * * * *